US005848838A

United States Patent [19]

Presta

[11] Patent Number: 5,848,838

[45] Date of Patent: Dec. 15, 1998

[54] GLASS MOUNTED LIGHT HOLDING STRIP

[76] Inventor: Mike Presta, 7505 Oak Bay, White Lake, Mich. 48383

[21] Appl. No.: 856,934

[22] Filed: May 15, 1997

[51] Int. Cl.[6] ..... F21V 21/00

[52] U.S. Cl. ..... 362/249; 248/224.7; 439/699.1; 439/457

[58] Field of Search ..... 248/205.3, 208, 248/224.7, 467, 225.11, 225.21, 229.16, 229.26; 362/226, 249, 250, 252, 217, 349, 348, 391, 238; 439/463, 465, 575, 699.1, 699.2, 356, 457

[56] References Cited

U.S. PATENT DOCUMENTS

| | | | |
|---|---|---|---|
| 3,275,818 | 9/1966 | Campell | 362/249 |
| 4,335,422 | 6/1982 | Van Ess | 362/388 |
| 4,357,653 | 11/1982 | Kovacs | 362/388 |
| 4,588,153 | 5/1986 | Boston et al. | 248/74.2 |
| 4,795,121 | 1/1989 | Comito | 248/314 |
| 4,821,158 | 4/1989 | Mitten | 362/249 |
| 4,888,671 | 12/1989 | Reimer | 362/250 |
| 5,067,061 | 11/1991 | Prickett | 362/249 |
| 5,255,866 | 10/1993 | Campolo | 242/85.1 |
| 5,355,288 | 10/1994 | Maddock | 362/238 |
| 5,425,518 | 6/1995 | Czerniak | 248/67.5 |
| 5,481,444 | 1/1996 | Schultz | 362/391 |
| 5,544,031 | 8/1996 | Blanton | 362/396 |
| 5,584,567 | 12/1996 | Rumpel | 362/249 |
| 5,595,439 | 1/1997 | Maddock et al. | 362/238 |
| 5,681,107 | 10/1997 | Wang | 362/249 |
| 5,707,136 | 1/1998 | Byers | 362/145 |

*Primary Examiner*—Leslie A. Braun
*Assistant Examiner*—T. Le
*Attorney, Agent, or Firm*—Gifford, Krass, Groh, Sprinkle, Patmore, Anderson & Citkowski, P.C.

[57] ABSTRACT

A holder for mounting decorative lights onto a flat surface. The holder includes an elongated strip which has an L-shaped cross-sectional profile. It includes a base and an upright disposed perpendicularly with respect to each other. A plurality of individual socket holders are disposed at regular intervals along the strip base. Each socket holder includes a pair of opposed slots for retaining a portion of the cord of a decorative light string therein. The socket holders are configured such that they retain a light socket therein in an orientation generally perpendicular to the plane of the strip base. The holder is particularly suitable for mounting directly onto window glass.

9 Claims, 1 Drawing Sheet

FIG-1
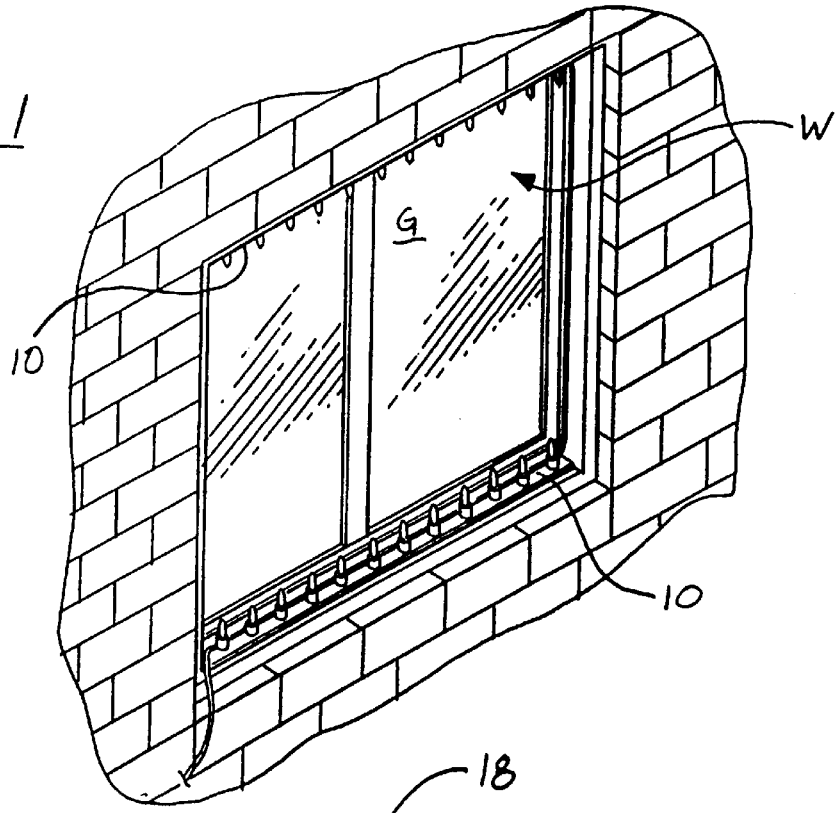
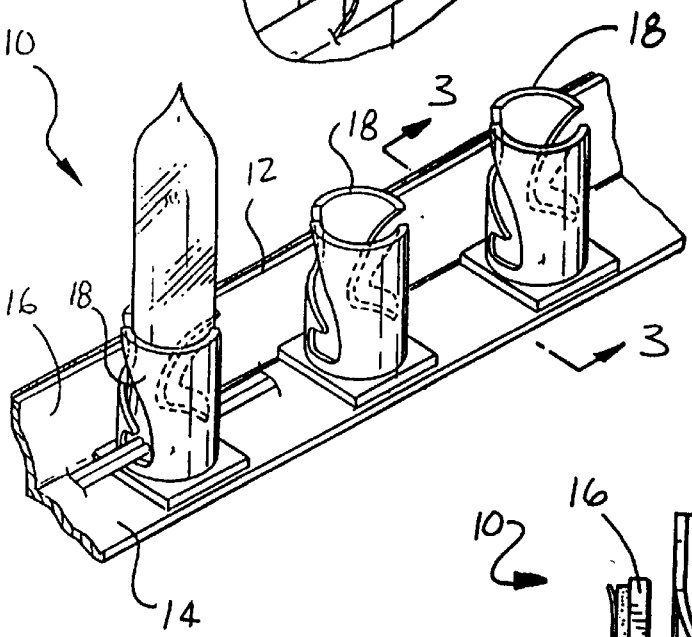
FIG-2
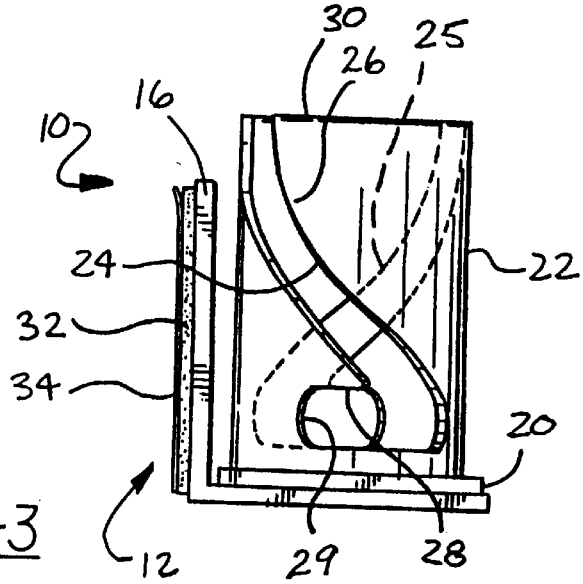
FIG-3

GLASS MOUNTED LIGHT HOLDING STRIP

FIELD OF THE INVENTION

This invention concerns the field of devices for mounting strings of individual, decorative lights and, more particularly, to a strip for mounting such a light string onto a window.

BACKGROUND OF THE INVENTION

Adorning residences and other buildings with strings of decorative lights has become an increasingly popular activity in recent years. Typically, such decorations are used during the Christmas season. Many people enjoy adorning the outside of their houses with multiple strings of miniature Christmas lights.

Many people like to place the lights around their windows. However, placing and securing the strings of lights to the window glass is both time consuming and difficult. For example, many people attempt to tape the strings of lights to the windows with less than satisfactory results.

Attaching strings of lights to a glass surface is particularly difficult since, unlike a wood or metal surface, it is virtually impossible to secure hooks or other types of holders to the glass. Thus, a light hanger such as is disclosed in U.S. Pat. No. 4,795,121 is secured to the frame surrounding the window, rather than to the glass, itself, by the use of screws or nails. Obviously, securing a light holder with fasteners of this type requires that unsightly holes are made in the window frame. U.S. Pat. No. 4,588,153 also discloses a holder for mounting strings of lights. The holder of the '153 patent is specifically designed to be attached to a nonporous, slippery surface, such as a window. This is accomplished by providing a plurality of suction cups onto a square frame provided with slits for retaining the cord of the light string. While such a device may be mounted directly to the window, it presents several drawbacks in that it must be custom designed to fit each window size and requires a minimum of four suction cups. Adhering that many suction cups to a glass surface is notoriously difficult.

Some other examples of prior art holders for strings of miniature lights may be seen in, for example, U.S. Pat. Nos.: 4,335,422; 4,357,653; 4,821,158; and 5,425,518.

In view of the various deficiencies of the prior art noted above, there is a need for a holder for mounting decorative lights onto a glass or other flat surface which is both easy to mount and capable of holding the lights securely.

There is also a need for such a holder which may easily be mounted directly onto a glass surface, such as a window.

There exists a further need for such a holder in which the individual light sockets may be easily and securely positioned for an attractive display.

SUMMARY OF THE INVENTION

The present invention has been designed to overcome the deficiencies of the prior art noted above. It is a holder for mounting a string of decorative lights, such as Christmas lights, on a flat surface such as a window pane.

In its broadest aspect, the holder comprises an elongated strip having an L-shaped cross-sectional profile and including an elongated upright and an elongated base disposed perpendicular to the upright.

A plurality of light socket holders are disposed on a surface of the elongated base at regular intervals thereon. Each light socket holder includes a bottom. In one embodiment, the bottom is formed by a portion of the base. In an alternate embodiment, it is a separate piece adhered thereto. And a wall member extending from the bottom. The wall is configured to surround a portion of a light socket disposed therein so as to maintain the socket in an orientation generally perpendicular to a plane defined by the elongated base.

A pair of slots is formed in the wall member of each socket at diametrically opposed locations. The slots are designed to receive and retain the cord of the light string. To that end, the slots include a first portion which opens onto a free end of the wall member and extends from said free end and along said wall member at an oblique angle with respect to the plane defined by the base. A second portion of the slot is configured in a hook shape and terminates in a blind end.

In a preferred embodiment, each pair of slots are oriented in opposite directions. That is, each pair includes a first slot having a second member extending toward the upright such that the blind end lies proximate thereto. The second slot of each pair has a second portion extending away from the upright such that the blind end thereof is displaced therefrom.

Means for adhering the strip to a flat surface such as a window pane is disposed on an outer surface of the elongated upright. In one embodiment, the means for adhering comprises a layer of contact adhesive applied to said elongated upright outer surface. A cover sheet is placed over the layer of contact adhesive so that the adhesive is protected. At the time of use, the cover sheet may be peeled away and the contact adhesive pressed against the mounting surface so that it will adhere thereto.

In another embodiment, the means for adhesion comprises a layer of double-sided adhesive tape which is applied to said elongated upright outer surface. Again, the adhesive tape may include a cover sheet.

Preferably, the elongated strip is extruded, molded or otherwise formed from a polymeric material such as polyethylene, polystyrene, polyvinyl chloride, acrylic resins, or any other suitable polymers. Preferably, the polymer is selected so that the strip will be transparent. Similarly, the holders may be formed of the same polymeric material and may be formed integrally with the elongated strip by, for example, a molding process, or may be formed separately and subsequently attached to the strip.

BRIEF DESCRIPTION OF THE DRAWINGS

The following detailed description is best understood by reference to the following drawings in which: FIG. 1 a perspective view of a window having a pair of holders according to the present invention mounted thereto for the display of decorative lights;

FIG. 2 is a perspective view of a portion of a holder constructed according to the present invention; and FIG. 3 is a cross-sectional view of the strip portion of FIG. 2 taken along lines 3—3.

DETAILED DESCRIPTION OF THE PREFERRED EMBODIMENTS

Throughout the following detailed description, like numerals are used to reference the same element of the present invention shown in multiple figures thereof. Referring now to the drawings, and in particular to FIGS. 1, 2 and 3 there is shown a holder 10 for mounting decorative lights onto a glass surface. The holder 10 includes an elongated strip 12 having an L-shaped cross-sectional profile (best seen in FIG. 3) and including an elongated base 14 and an elongated upright 16 disposed perpendicularly to said elongated base 14. FIG. 1 shows a pair of strips 10 mounted directly onto the window glass G of a residential window W.

A plurality of light socket holders 18 are disposed at regular intervals along an inside surface of elongated base 14 in the manner depicted in FIG. 2. Alternately, the holders 18 could be mounted to an outside surface of base 14. Each individual socket holder 18 includes a bottom 20 adhered to said inside surface of elongated base 14. A wall member 22 extends from said bottom 20 and is configured to surround a portion of an individual light socket disposed therein in the manner depicted in FIG. 3 such that the light socket is in an orientation generally perpendicular to a plane defined by said elongated base 14.

In an alternative embodiment (not depicted), the bottom of each individual socket holder 18 may be formed by a portion of said elongated base 14 such that the wall member 22 extends directly from the elongated member 14.

A pair of opposed slots 24, 25 (best seen in FIG. 3) are formed in wall member 22 at diametrically opposed locations thereon. The slots 24, 25 open onto a free edge 30 of said wall member 22 and include a first portion 26 which extends downward along the wall member 22 at an oblique angle with respect to said elongated base plane. It has been found that the angled orientation of the slots as depicted in FIG. 3 helps to retain the cord portion of the light string therein.

Each slot 24, 25 also includes a second portion 28 which is configured as a hook 28 and terminates in a blind end 29.

In the embodiment depicted in FIG. 3, the angular orientation of each pair of opposed slots 24, 25 is opposite. That is, slot 24 is oriented such that its first portion 26 angles toward the elongated upright 16, and the second portion 28 extends away from the elongated upright 16 such that its blind end is spaced therefrom. In contrast, slot 25 is angled such that its first member 24 extends away from elongated upright 16, and its second portion 28 extends toward elongated upright 16. Thus, the blind end 29 of slot 25 is disposed proximate elongated upright 16. Again, it has been found that, by opposing the orientations of each opposed pair of slots, the cord of the string of lights is better retained therein.

An adhering means in the form of a double-sided strip of adhesive tape 32 is disposed on an outer surface of elongated upright 16. A strip of paper 34 is disposed on the outer surface of the adhesive tape 32 to protect it.

The manner of use of the holder will now be described. First, each strip is mounted to the mounting surface. For example, if the lights are being mounted around a window, the user will mount the strips directly to the glass surface. At the user's option, any number of strips may be used on each window. After the window surface is prepared by thoroughly cleaning it, the paper strip 34 is peeled away from the double-sided adhesive tape 32 to expose its adhesive surface. The strip is then mounted in the desired position directly onto the window glass.

After the strip is in place, a string of decorative lights may be installed therein. As is best seen in FIGS. 2 and 3, each individual light socket of the string of lights is inserted into a socket holder 18 by simply inserting a portion of the cord at each side of the socket into the pair of opposed slots 24, 25. This is easy to do since the slots are designed so that the cord may simply be slipped in. The hook configuration of the slots, as well as their oblique orientation, helps retain the socket therein, and retain it in an orientation perpendicular to the plane of the strip base.

Thus, when the lights have been installed in the described manner, each individual light will be oriented roughly parallel to the glass surface upon which the strip has been installed. This gives a very pleasing, decorative effect, particularly because the glass will reflect the light back to the observer.

Of course, it is to be understood that, while the holder of the present invention is particularly suitable for installing decorative lights onto window glass, it can be used to install the lights onto any flat, smooth surface. Furthermore, the holder of the present invention can be used either indoors or out. For example, the holder is particularly suitable for mounting decorative lights onto the surface of a mirror.

Preferably, the components of the holder, including the strip and the individual socket holders, are formed of any suitable lightweight polymeric material. Because the strips are very lightweight, they are easy to handle and mount. Furthermore, their light weight enables them to be mounted by means of adhesive tape or an adhesive layer as already described. Thus, no other mounting hardware is required. When it comes time to remove the decorative lights, the strips may be left in place.

It is also possible to mount the holder of the present invention to a flat surface with the decorative lights already mounted therein.

Thus, there has been described a holder for mounting decorative lights onto a flat surface which includes an elongated strip having a base and an upright at right angles with respect to each other. A plurality of individual socket holders are mounted to the base at regular intervals thereon. Each socket holder includes a pair of slots for retaining the cord portion of the string of lights. The holder further includes means for adhering the strip to a flat surface.

The present invention has been described with reference to certain exemplifications and embodiments thereof. Doubtless, one of skill in the art, having had the benefit of the teachings of the present invention, could design certain modifications thereof. For example, although the depicted embodiment shows the individual socket holders mounted onto an inside surface of the strip base, it would be possible to mount them on the outside surface of the base. Furthermore, each socket holder could be configured somewhat differently than depicted. Such design modifications do not depart from the scope of the present invention. Thus, it is the claims appended hereto, and all reasonable equivalents thereof, rather than the exact depicted embodiments and exemplifications, which define the scope of the present invention.

I claim:

1. A holder for mounting a string of decorative lights onto a flat surface comprising:

an elongated strip configured to have an L-shaped cross-sectional profile and including an elongated upright and an elongated base disposed perpendicular thereto;

a plurality of light socket holders disposed at regular intervals along a surface of said elongated base, each of said holders including:

a bottom and a wall member extending therefrom, said wall member configured to surround a portion of a light socket disposed therein so as to maintain said socket in an orientation generally perpendicular to a plane defined by said elongated base;

a pair of slots formed in said wall member at diametrically opposed locations, said slots opening onto a free edge of said wall member, each of said pair of slots including a first portion extending from said free edge along said wall member at an oblique angle with respect to said plane, and a second portion configured as a hook disposed proximate said holder bottom and terminating in a blind end, each pair of slots including a first slot having its hook extending toward said upright and a second slot having its hook extending away from said upright; and means for adhering said strip to a flat surface, said means being disposed on an outer surface of said strip base.

2. The holder of claim 1 wherein said strip is formed of a polymeric material.

3. The holder of claim 2 wherein said strip is formed of a transparent polymeric material.

4. The holder of claim 1 wherein said adhering means comprises a layer of two-sided adhesive applied to said strip base outer surface and a cover layer adhered to said adhesive layer.

5. The holder of claim 1 wherein said adhering means comprises a strip of double-sided adhesive tape disposed on said base outer surface.

6. The holder of claim 1 wherein the bottom of each socket holder is formed by a portion of said base, said wall member extending directly from said base.

7. The holder of claim 1 wherein the bottom of each socket is a separate member adhered to said base.

8. The holder of claim 1 wherein said socket holders are mounted on an inside surface of said base.

9. The holder of claim 1 wherein said socket holders are mounted on an outside surface of said base.

* * * * *

UNITED STATES PATENT AND TRADEMARK OFFICE

CERTIFICATE OF CORRECTION

PATENT NO. : 5,848,838

DATED : December 15, 1998

INVENTOR(S) : Mike Presta

It is certified that error appears in the above-indentified patent and that said Letters Patent is hereby corrected as shown below:

Column 2, line 3, delete "extending" and insert --extends--.
Column 2, line 16, delete "are" and insert --is--.
Column 3, line 13, delete "3" and insert --2--.
Column 3, line 20, delete "are" and insert --is--.
Column 3, line 35 delete "extends away from the elongated" and insert --is spaced from--; delete "such that its".
Column 3, line 36, delete "blind end is spaced therefrom".
Column 3, line 37, delete "its first member 24"; delete "away from" and insert --toward--.
Column 3, line 38, delete "extends" and insert --continues extending--.
Column 5, claim 1, line 9, delete "base" and insert --upright.
Column 5, line 4, line 16, delete "base" and insert --upright--.
Column 6, claim 5, line 3, delete "base" and insert --upright--.
Column 6, claim 6, line 5, delete "base" and insert --upright--.

Signed and Sealed this

Tenth Day of April, 2001

*Attest:*

Nicholas P. Godici

NICHOLAS P. GODICI

*Attesting Officer*

*Acting Director of the United States Patent and Trademark Office*